US009462363B2

(12) United States Patent
Wirth et al.

(10) Patent No.: US 9,462,363 B2
(45) Date of Patent: Oct. 4, 2016

(54) SOUND GENERATOR FOR AN EXHAUST SYSTEM

(71) Applicant: Eberspächer Exhaust Technology GmbH & Co. KG, Neunkirchen (DE)

(72) Inventors: Georg Wirth, Kirchheim/Teck (DE); Ralf Hölsch, Epfendorf (DE); Frank Sauter, Leinfelden-Echterdingen (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 174 days.

(21) Appl. No.: 14/268,074

(22) Filed: May 2, 2014

(65) Prior Publication Data

US 2014/0328493 A1 Nov. 6, 2014

(30) Foreign Application Priority Data

May 3, 2013 (DE) ..... 10 2013 208 186

(51) Int. Cl.

| | |
|---|---|
| ***H04R 1/02*** | (2006.01) |
| ***F01N 1/06*** | (2006.01) |
| ***G10K 11/178*** | (2006.01) |
| *F01N 13/18* | (2010.01) |

(52) U.S. Cl.

CPC ..... *H04R 1/028* (2013.01); *F01N 1/065* (2013.01); *G10K 11/178* (2013.01); *F01N 13/18* (2013.01); *F01N 13/1805* (2013.01); *F01N 13/1888* (2013.01); *G10K 2210/12822* (2013.01)

(58) Field of Classification Search

CPC ..... G10K 2210/12822; G10K 11/178; H04R 2499/13; H04R 1/028; H04R 1/025; F01N 1/065; F01N 13/1866; F01N 13/1888; F01N 2450/24; F01N 2530/18; F16L 55/0333

USPC ..... 381/86, 71.5, 103

See application file for complete search history.

(56) References Cited

U.S. PATENT DOCUMENTS 5,097,923 A * 3/1992 Ziegler ..... F01N 1/065 181/206
5,236,100 A * 8/1993 Shin ..... B65D 90/34 220/745

(Continued)

FOREIGN PATENT DOCUMENTS

DE 10 2011 084 567 A1 4/2013
DE 10 2011 089 283 A1 6/2013

(Continued)

*Primary Examiner* — Davetta W Goins
*Assistant Examiner* — Oyesola C Ojo
(74) *Attorney, Agent, or Firm* — McGlew and Tuttle, P.C.

(57) ABSTRACT

A sound generator (1) for an exhaust system (2) of an internal combustion engine of a motor vehicle (3) includes a housing (4), with an electroacoustic converter (5) having a membrane (6) separating a housing rear volume (9) from a housing front volume (10). A connection pipe (11) connects the front volume (10) of the sound generator (1) to an exhaust gas-carrying exhaust gas line (12) fluidically and acoustically. To reduce the risk of damage to the membrane (6), for example, in case the housing (4) becomes flooded, a pressure equalization line (15) is connected by a proximal end (16) to the housing (4) on the outside and is connected fluidically with the rear volume (9) through an opening (18) in the housing. A distal end (17) of the pressure equalization line (15) is at a spaced location from the housing (4).

20 Claims, 2 Drawing Sheets

(56) References Cited

U.S. PATENT DOCUMENTS

| | | | | |
|---|---|---|---|---|
| 5,408,221 | A * | 4/1995 | Carsella, Sr. | B63B 35/816 116/173 |
| 6,698,976 | B1 * | 3/2004 | Cho | E03B 3/20 166/187 |
| 2009/0255754 | A1 * | 10/2009 | Kruger | F16L 55/0333 181/206 |
| 2015/0046032 | A1 * | 2/2015 | Clarke | B60G 17/0165 701/37 |

FOREIGN PATENT DOCUMENTS

| | | | | |
|---|---|---|---|---|
| EP | 1 055 804 | A1 | 11/2000 | |
| EP | 2 108 791 | A1 | 10/2009 | |
| EP | 2 581 567 | A1 | 4/2013 | |
| EP | 2 607 640 | A1 | 6/2013 | |
| FR | 2 803 625 | A1 | 7/2001 | |
| JP | 08134520 | A * | 5/1996 | C21B 11/00 |

* cited by examiner

Fig. 1A
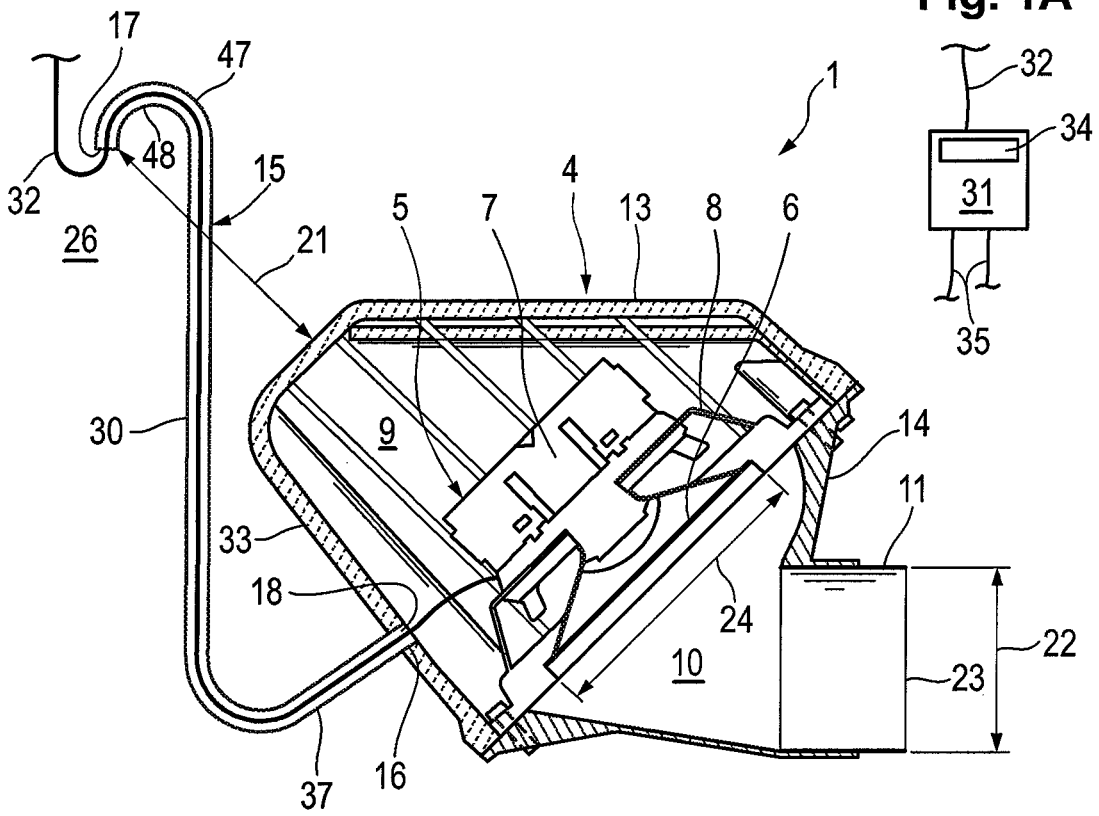
Fig. 1
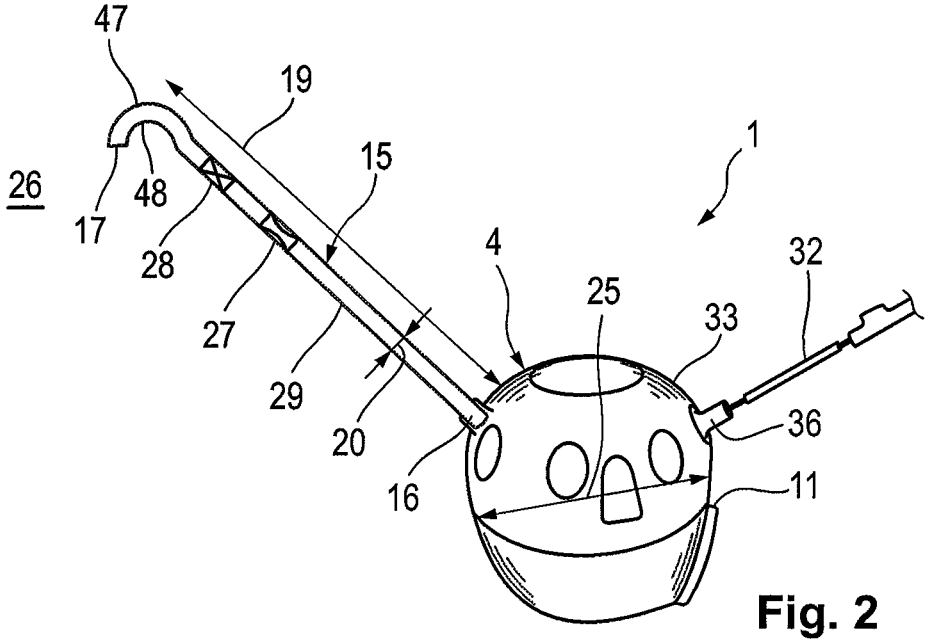
Fig. 2

SOUND GENERATOR FOR AN EXHAUST SYSTEM

CROSS REFERENCE TO RELATED APPLICATIONS

This application claims the benefit of priority under 35 U.S.C. §119 of German Patent Application 10 2013 208 186.3 filed May 3, 2013, the entire contents of which are incorporated herein by reference.

FIELD OF THE INVENTION

The present invention pertains to a sound generator for an exhaust system of an internal combustion engine of a motor vehicle. The present invention pertains, in addition, to a motor vehicle equipped with such a sound generator.

BACKGROUND OF THE INVENTION

A sound generator of this kind has, in a housing, at least one electroacoustic converter, preferably in the form of a loudspeaker. A membrane of the converter separates a rear volume from a front volume in the housing. The sound generator can be connected via a connection pipe to an exhaust gas-carrying exhaust gas line of the exhaust system, and the connection pipe then connects the front volume with the exhaust gas line fluidically and acoustically in the connected state.

Such a sound generator may be used, for example, as an active exhaust muffler to reduce undesired noises, which propagate as air-borne noise in the exhaust gas line. Corresponding active noise control is generated for this by means of the electroacoustic converter and emitted in a phase-shifted manner, so that sound and active noise control are superimposed to one another, which leads to a reduction of the amplitudes of the disturbing sound. In addition, or as an alternative, such a sound generator may also be used to specifically intensify or generate certain engine noises. The sound of an exhaust system or of the internal combustion engine can be specifically affected in this manner by means of such a sound generator.

The rear volume enclosed in the housing of the sound generator has a housing internal pressure, which must be essentially at equilibrium with an external pressure prevailing in the front volume when the membrane is not moving in order for the membrane to be able to assume its neutral central position. To prevent the membrane from performing permanent deflections from its neutral position, which can lead to damage to the membrane, in case of changes in weather, which are accompanied by a change in the ambient pressure, and during temperature changes, the housing may be equipped in the conventional manner with a pressure equalization opening, which makes possible a static pressure equalization between the rear volume and an area surrounding the housing. In order for such a pressure equalization opening to permit a static pressure equalization only, while it prevents a dynamic pressure equalization, such a pressure equalization opening is provided, as a rule, with a correspondingly small opening cross section. Static pressure equalization usually takes place at a frequency of less than 1 Hz. Contrary to this, a dynamic pressure equalization takes place, as a rule, at a frequency higher than 10 Hz. Dynamic pressure equalization must be avoided in order to make it possible to guarantee the ability of the converter to function.

To prevent splash water from entering the housing through the pressure equalization opening during the operation of the vehicle, it is possible to equip the pressure equalization opening with a corresponding splashproof protection. It is also conceivable to equip the pressure equalization opening with a semipermeable membrane, which is impermeable to liquids while it is permeable to gases. The permeability to gas of such a semipermeable membrane is selected to be such that the desired pressure equalization is possible.

In addition, the problem arises in case of all-terrain vehicles as well as of vehicles with off-road ability, especially in so-called SUVs, where SUV means sport utility vehicle, that the entire housing of the sound generator may be surrounded by water when driving through bodies of water. Even though the semipermeable membrane does offer protection against the entry of water into the housing in such cases as well, it is no longer able to ensure pressure equalization for the rear volume against the water pressure prevailing on the outside. In particular, the path of flow of ambient air into the rear volume is blocked by the water surrounding the housing. The temperature of the exhaust system rises markedly against the environment during normal operation of the vehicle. In particular, the temperature of the housing of the sound generator rises as well. The pressure rising in proportion to the temperature in the rear volume can be permanently equalized with the surrounding area by air leaving the rear volume in proportion to the temperature through the pressure equalization opening and entering the surrounding area. If the vehicle now passes through a body of water that is so deep that the housing will be flooded, the housing will cool down relatively sharply in a short time, and so will the air enclosed in the rear volume. Air would now have to enter the rear volume from the environment for pressure equalization. However, this path is blocked by the water that surrounds the housing. Thus, static pressure equalization is not possible in this special case. The position of the membrane changes greatly in the direction of the rear volume, and the membrane may become permanently damaged.

Furthermore, it may happen while driving through a body of water that water may enter the exhaust system through a tail pipe and reach the sound generator, as a result of which the latter is flooded quasi on the side of its front volume. The dynamic pressure of the water likewise pushes the membrane into the rear volume. A membrane drive of the converter cannot drive the membrane any more against this dynamic pressure or it can do so to a very limited extent only. Since the output of the usually electromagnetic membrane drive cannot be converted into motions of the membrane in this case, overheating of the membrane drive may occur.

SUMMARY OF THE INVENTION

The object of the present invention is to provide an improved embodiment for a sound generator of the type mentioned in the introduction for a vehicle equipped therewith, which embodiment is characterized especially in that the risk of damage to the sound generator during travel through a body of water is reduced.

According to the invention, a motor vehicle internal combustion engine exhaust system sound generator is provided comprising a housing and an electroacoustic converter arranged in the housing. The electroacoustic converter comprises a membrane separating a rear volume from a front volume in the housing. A connection pipe connects the sound generator to an exhaust gas-carrying exhaust gas line of the exhaust system. The connection pipe connects the front volume fluidically and acoustically with the exhaust system in a connected state. A pressure equalization line is provided having a pressure equalization line proximal end connected to the housing and connected fluidically with the rear volume through an opening in the housing. The pressure equalization line has a pressure equalization line distal end arranged at a spaced location from the housing.

The present invention is based on the general idea of equipping the housing with the pressure equalization line, which is connected with the proximal end to the housing on the outside and is fluidically connected there with the rear volume through a housing opening, while the distal end of the pressure equalization line is arranged at the same time at a spaced location from the housing and is open to the respective surrounding area. Due to the use of such a pressure equalization line, the distal end of the pressure equalization line can be positioned so far above the housing if the pressure equalization line has a corresponding length that pressure equalization with the surrounding area is possible even if the housing of completely surrounded, because the distal end of the pressure equalization line is still above the water line even then. Therefore, the pressure equalization line functions as a kind of snorkel and makes possible a static pressure equalization for the rear volume even with the housing fully submerged.

According to an advantageous embodiment, the length of the pressure equalization line may be so great that a distance that is greater than a diameter of the connection pipe at a pipe end facing away from the housing or that is greater than a diameter of the membrane or is greater than a diameter of the housing in the area of the rear volume can be set for the distal end from the housing. It is thus made clear that the pressure equalization line has a markedly larger dimension than, for example, a connecting branch, which may be attached to the housing to embody a conventional pressure equalization opening. By selecting the length of the line correspondingly, the distal end of the pressure equalization line can be positioned, in principle, at any desired point inside and outside the vehicle. The pressure equalization line is fluidically connected by its distal end with an area surrounding the pressure equalization line, as a result of which exchange of air and this pressure equalization between this surrounding area and the rear volume is possible, in particular.

At least one throttling means, which makes possible a static pressure equalization for the rear volume and prevents dynamic pressure equalization, may be arranged in the pressure equalization line in another advantageous embodiment. The pressure equalization line itself can be embodied in this manner with a comparatively large open cross section, especially such that dynamic pressure equalization would also be possible. The use of a throttling means makes it possible to set a specific throttling action, as a result of which the pressure equalization line has increased reliability of operation. Such a throttling means may be formed, for example, by means of a semipermeable membrane, which is permeable to gases and impermeable to liquids.

At least one filter means, which prevents contaminants from entering the rear volume, may be arranged in the pressure equalization line in another advantageous embodiment. Such a filter means may be formed, for example, by a semipermeable membrane. As an alternative, a filter means may also be formed by an open-pore foam body.

In another advantageous embodiment, the pressure equalization line may have an elastic tubing or a rigid pipe between its ends. The use of an elastic tubing to embody the pressure equalization line opens up a simplified possibility of installing the pressure equalization line in the vehicle. The use of a rigid pipe to embody the pressure equalization line may be used, for example, to fasten the housing on a periphery of the vehicle.

Corresponding to another advantageous embodiment, which may also represent an independent solution to the object, because it can also be embodied, in principle, without the above-mentioned pressure equalization line, a control means, which has an emergency shut-off, may be provided for driving a membrane drive of the loudspeaker. The emergency shut-off is configured such that it leads to a reduction or interruption of the power supply to the membrane drive in case of flooding of the front volume with a liquid. The power supply is advantageously reduced or interrupted until flooding is eliminated. For example, the control means can monitor the power consumption of the membrane drive and identify flooding of the front volume on the basis of a significantly changing power consumption. It is likewise possible to provide a corresponding sensor system, which identifies flooding of the exhaust system. Such a sensor system may be present on the vehicle anyway. The control means of the sound generator can then be connected, for example, to a control device of the vehicle in a corresponding manner in order to make it possible to detect the flooding of the front compartment.

Corresponding to another advantageous embodiment, a cable harness for the power supply and/or for the electric driving of at least one electric component of the sound generator arranged in the rear volume, for example, of a membrane drive, may be led through the entire pressure equalization line or at least through a proximal end section of the pressure equalization line having the proximal end. The pressure equalization line can be additionally used in this manner to lead the cable harness through a housing wall, so that a separate wall bushing for the cable harness can be eliminated. At least in the case in which the cable harness is led through the entire pressure equalization line, a separate sealing for the cable bushing, which is absolutely necessary, for example, in case of a separate wall bushing, can be eliminated.

The sound generator being presented here may be designed as an active muffler, so that the sound generated by means of the respective converter makes it possible to reduce the amplitudes of undesired frequencies of the sound that propagates in the exhaust system in case of a corresponding phase shift. In addition or as an alternative, the sound generator may also be used as a sound generator to amplify or generate certain frequencies in a specific manner. Especially advantageous is a combined use, in which the amplitudes are reduced with active noise control at certain frequencies by means of the sound generator, while the amplitudes are amplified or generated at certain other frequencies at the same time.

The vehicle according to the present invention comprises an internal combustion engine for driving the vehicle as well as an exhaust system for removing exhaust gas from the internal combustion engine. The vehicle has, besides, an underbody, which is arranged on the underside of the vehicle, which underside faces a ground, on which the vehicle stands or travels. The exhaust system is arranged in an end section located away from the internal combustion engine on the underside of an underbody, which said underside faces the ground. Further, the exhaust system has, in its end section, at least one sound generator of the above-described type. In its end section, the exhaust system has an exhaust gas-carrying exhaust gas line, to which the connection branch of the sound generator is connected. Further, provisions are made for the pressure equalization line of the sound generator to be arranged with its distal end above the housing of the sound generator on the vehicle.

According to an advantageous embodiment, the distal end of the pressure equalization line may be arranged on the underside of the underbody, and a distal end section of the pressure equalization line having the distal end is bent or curved such that the distal end is open downwardly. Improved protection against splash water is achieved hereby.

According to an advantageous variant, the distal end section may have a bent section, which defines a bend of at least 90° and especially a bend of up to 180°.

If the distal end of the pressure equalization line is arranged on the underside of the underbody, the distal end can be positioned, for example, in the area of a wheel housing, namely, preferably in an upper area of the respective wheel housing. Further, the distal end of the pressure equalization line is advantageously positioned above a predetermined maximum wading depth, which is intended for the respective vehicle. For example, a wading depth of at least 500 mm above ground may be desirable.

In another embodiment, the pressure equalization line may pass through the underbody in a sealed manner, so that the distal end is arranged on an underside of the underbody facing away from the ground. The distal end may open now, for example, into a rear trunk of the vehicle or into an interior space of the vehicle. Entry of water into the pressure equalization line is ruled out nearly completely in this manner.

The end section of the exhaust system with the exhaust gas line and with the housing of the sound generator may be arranged below a predetermined maximum wading depth of the vehicle in another advantageous embodiment. The tail pipe may also be arranged below the wading depth. Contrary to this, the distal end of the pressure equalization line is arranged above the wading depth.

Corresponding to an advantageous variant, the exhaust gas line may lead to a tail pipe of the exhaust system, which tail pipe is open to the surrounding area, or be formed by the tail pipe, which likewise opens below the maximum wading depth. It is possible in this case that the end section of the exhaust system is flooded while traveling through a body of water, such that water reaches the front volume of the sound generator.

Finally, the present invention pertains, besides, to a method for operating a vehicle of the above-described type. This operating method is characterized in that power supply to a membrane drive of the electroacoustic converter is reduced or interrupted as soon as and as long as the front volume of the housing is flooded through the tail pipe. Overheating of the membrane drive can be efficiently avoided in this manner.

It is apparent that the above-mentioned features, which will also be explained below, can be used not only in the particular combination indicated but in other combinations or alone as well, without going beyond the scope of the present invention.

Preferred embodiments of the present invention are shown in the drawings and will be explained in more detail in the following description, where identical reference numbers designate identical or similar or functionally identical components. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

FIG. 1 is a highly simplified sectional view of a sound generator according to the invention;

FIG. 1A is a schematic view of a control with an emergency shut-off;

FIG. 2 is an isometric view of the sound generator, but in another embodiment.

DESCRIPTION OF THE PREFERRED EMBODIMENTS

Figure 3:
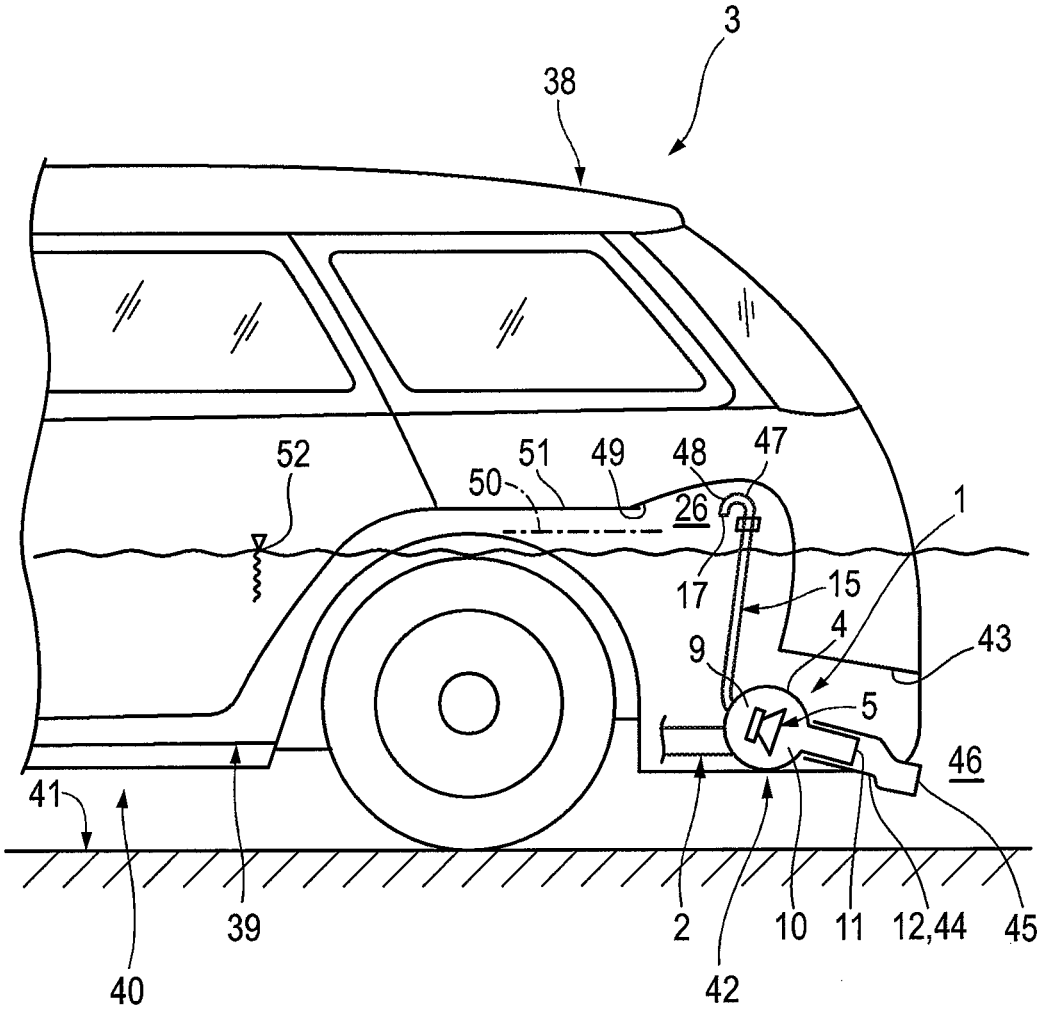
FIG. 3 is a highly simplified side view of a vehicle in a rear area, which is equipped with such a sound generator.

Corresponding to FIGS. 1 through 3, a sound generator 1, which is intended for an exhaust system 2 of an internal combustion engine, not shown, of a vehicle 3, which can be recognized in FIG. 3 only, where said exhaust system 2 shown partially in FIG. 3, has a housing 4, in which at least one electroacoustic converter 5, for example, in the form of a loudspeaker, is arranged. The converter 5 has a membrane 6, a membrane drive 7 and a cage 8. The membrane 6 separates in the housing 4 a rear volume 9 from a front volume 10. The membrane drive 7 operates, for example, electromagnetically and is used to drive the membrane 6. The cage 8 fixes the membrane 6 and carries the membrane drive 7.

The sound generator 1 has, in addition, a connection pipe 11, by means of which the sound generator 1 can be connected to an exhaust gas-carrying exhaust gas line 12 of the exhaust system 2. The connection pipe 11 is used for the fluidic and acoustic coupling of the front volume 10 with the exhaust gas line 12 or with the interior space of the exhaust gas line 12 in the connected state. Sound waves, which are generated by means of the membrane 6, enter the exhaust gas line 12 in this manner through the front volume 10 and through the connection pipe 11 in order to modify there the sound being transported therein.

According to FIG. 1, the housing 4 may have a pot-shaped housing part 13 and a cover-shaped housing part 14, which is firmly attached to the pot-shaped housing part 13 to close an opening of said pot-shaped housing part 13. The converter 5 is arranged in the example on the cover-shaped housing part 14 via its cage 8 as well as the connection pipe 11. The cover-shaped housing part 14 defines, furthermore, the front volume 10. Contrary to this, the pot-shaped housing part 13 defines the rear volume 9.

The sound generator 1 being presented here has, moreover, a pressure equalization line 15, which has a proximal end 16 as well as a distal end 17 relative to the housing 4. The pressure equalization line 15 is connected with its proximal end 16 to the housing 4 on the outside and is fluidically connected there through an opening of the housing with the rear volume 9. Contrary to this, the distal end 17 is arranged at a spaced location from the housing 4.

The pressure equalization line 15 has a line length 19 indicated in FIG. 2, which is great compared to a diameter 20. In particular, the line length 19 is at least 10 times the line diameter 20. Due to the great line length 19, a distance 21 that is greater than a diameter 22 of the connection pipe 11 can be set at a pipe end 23 facing away from the housing 4 according to FIG. 1 for the distal end 17 relative to the housing 4. According to the embodiments according to FIGS. 2 and 3, this distance may also be greater than a diameter 24 of the membrane 6, which diameter is shown in FIG. 1. This distance 21 may also be greater than a diameter 25 of the housing 4, which diameter is shown in FIG. 2, in the area of the rear volume 9. The distal end 17, which is open towards a surrounding area 26, can thus be arranged at a spaced location relative to the housing 4.

According to FIG. 2, the pressure equalization line 15 may have at least one throttling means 27. The throttling means 27 is designed such that it makes possible a static pressure equalization between the rear volume 9 and the surrounding area 26, while it prevents a dynamic pressure equalization between the rear volume 9 and the surrounding area 26, while it is permeable to gases.

According to FIG. 2, the pressure equalization line 15 may have, moreover, a filter means 28, which is designed such that it prevents liquid and/or solid contaminants from entering the rear volume 9, while it is permeable to gases.

According to FIG. 2, a pressure equalization line 15 may have a rigid pipe 29 between its ends 16, 17. As an alternative hereto, an elastic tubing 30 may be provided between the ends 16, 17.

According to FIG. 1, the sound generator 1 may be equipped, moreover, with a control means 31, which is provided for driving the membrane drive 7. The control means 31 is advantageously arranged outside the housing 4, for example, on a suitable periphery of the vehicle 3. A cable harness 32, which can be led through a wall 33 of the housing in a suitable manner, is provided for coupling the control means 31 with the membrane drive 7. The cable harness 32 is used for power supply as well as for electrically driving the membrane drive 7 as well as optionally further electric and/or electronic components of the converter 5 or of the sound generator 1.

The control means 31 has an emergency shut-off 34, which is designed and programmed such that it reduces or preferably interrupts the power supply in case the front volume 10 is flooded with a liquid, preferably until flooding is over. For example, the control means 31 may be coupled for this with a sensor system suitable for this, which is not shown here, via corresponding signal lines 35. The control means 31 can likewise recognize from the power consumption of the membrane drive 7 whether the front volume 10 is flooded or not.

According to FIG. 2, the above-mentioned cable harness 32 can be led through a hole 33 of the housing by means of a cable bushing 36 in a sealed manner. As an alternative, it is possible according to a preferred solution shown in FIG. 1 to lead the cable harness 32 through the pressure equalization line 15, so that no separate cable bushing 36 is necessary for the cable harness 32. The cable harness 32 is led through the entire pressure equalization line 15 in FIG. 1. It is also conceivable, in principle, to lead the cable harness 32 through a part of the pressure equalization line 15 only, preferably through a proximal end section 37 of the pressure equalization line 15 having the proximal end 16.

The vehicle 3 shown in FIG. 3 has, in the usual manner, an internal combustion engine, not shown here, for driving the vehicle 3. The vehicle 3 is shown in a rear area 38 in FIG. 3. The internal combustion engine is preferably located in a front area, but this area is not shown here. As was mentioned, the vehicle 3 has an exhaust system 2, but it is shown only partially in the rear area 38. The exhaust system 2 is used in the usual manner to remove exhaust gas from the internal combustion engine.

The vehicle 3 has, further, an underbody 39, which is located in the usual manner on the underside 40 of the vehicle, which underside faces a ground 41, on which the vehicle 3 stands or travels. The exhaust system 2 is arranged, at least in an end section 42 located away from the internal combustion engine, on the underside 43 of the underbody, which underside faces the ground 41. The exhaust system 2 has the sound generator 1 as well as the exhaust gas line 12 in this end section 42. The exhaust gas line 12 is a tail pipe 44 in this case, whose discharge end 45 opens into a surrounding area 46. The pressure equalization line 15 is arranged on the vehicle 1 such that its distal end 17 is located above the housing 4. The distal end 17 is arranged on the underside 43 of the underbody in the example shown in FIG. 3.

According to FIGS. 1 through 3, a distal end section 47 of the pressure equalization line 15, which end section has the distal end 17, is bent such that the distal end 17 is open downwardly. The distal end section 47 has a bent section 48 for this, which defines a bend of about 180°. The distal end section 47 is positioned in a wheel housing 49 in the example shown in FIG. 3. At any rate, the distal end 17 is located above a predetermined maximum wading depth 50, which is indicated by a dash-dotted line in FIG. 3. This maximum wading depth 50 may be located at a distance of, for example, 500 mm from the ground 41.

The pressure equalization line 15 may pass through the underbody 39 in a sufficiently sealed manner in an alternative embodiment, not shown here, such that the distal end 17 is arranged on an underside 51 of the underbody facing away from the ground 41. For example, the distal end 17 may now open in an open form into a trunk or into a rear compartment or into an interior space of the vehicle 3.

As can be determined from FIG. 3, the aforementioned end section 42 of the exhaust system 2 is arranged below the maximum wading depth 50 at least in the area of the exhaust gas line 12 and thus of the tail pipe 44 as well as in the area of the housing 4 of the sound generator 1. The discharge opening 45 of the tail pipe 44 is likewise arranged, in particular, below this wading depth 50.

When passing through a body of water, it may thus happen according to FIG. 3 that, on the one hand, the exhaust system 2 will be flooded from the outside in the area of the end section 42. A possible water level is designated by 52 in FIG. 3. On the other hand, said end section 42 may also be flooded from the inside through the tail pipe 44. The flooding from the outside leads to rapid cooling of the housing 4 and thus to a reduction of the pressure in the rear volume 9. This pressure reduction can be statically equalized via the pressure equalization line 15, as a result of which the membrane 6 of the converter 5 can be prevented from being damaged. Flooding of the end area 42 of the exhaust system 2 may also lead to flooding of the front volume 10 from the inside, which may likewise lead to an undesired deflection of the membrane 6 in the direction of the rear volume 9. However, it is more serious in this case that the membrane drive 7 cannot drive the membrane 6 any longer with the front volume 10 flooded, as a result of which the membrane drive 7 may overheat. As was explained farther above, the control means 31 can recognize the flooding of the front volume 10 and correspondingly respond to reduce or interrupt the power supply to the membrane drive 7 in order to prevent overheating of the membrane drive 7 in this manner.

While specific embodiments of the invention have been shown and described in detail to illustrate the application of the principles of the invention, it will be understood that the invention may be embodied otherwise without departing from such principles.

What is claimed is:

1. A motor vehicle internal combustion engine exhaust system sound generator comprising:

a housing;

an electroacoustic converter arranged in the housing, the electroacoustic converter comprising a membrane separating a rear volume from a front volume in the housing;

a connection pipe connecting the sound generator to an exhaust gas-carrying exhaust gas line of the exhaust system, the connection pipe connecting the front volume fluidically and acoustically with the exhaust system in a connected state; and a pressure equalization line having a pressure equalization line proximal end connected on to the housing and connected fluidically with the rear volume through an opening in the housing and having a pressure equalization line distal end arranged at a spaced location from the housing, wherein the pressure equalization line has a line length extending away from a rear of the housing, away from to the electroacoustic converter and away from the connection pipe to the distal end, such that the distal end is spaced away from the rear of the housing, and spaced away from the electroacoustic converter and spaced away from the connection pipe by a distance that is greater than at least one of:

a diameter of the connection pipe at a connection pipe end facing away from the housing;

a diameter of the membrane; and a diameter of the housing in an area of the rear volume.

2. A sound generator in accordance with claim 1, further comprising a throttling means arranged in the pressure equalization line, the throttling means for restricting flow in the pressure equalization line to allow a static pressure equalization for the rear volume and to prevent a dynamic pressure equalization.

3. A sound generator in accordance with claim 1, further comprising a filter means arranged in the pressure equalization line, the filter means for preventing contaminants from entering the rear volume.

4. A sound generator in accordance with claim 1, wherein the pressure equalization line comprises at least one of elastic tubing and a rigid pipe between the pressure equalization line proximal end and the pressure equalization line distal end.

5. A sound generator in accordance with claim 1, further comprising a control means for driving a membrane drive of the electroacoustic converter, the control means including an emergency shut-off for reducing or interrupting a power supply to the membrane drive in case the front volume is flooded with a liquid, until flooding is over.

6. A sound generator in accordance with claim 1, further comprising a cable harness for supplying an electric component of the sound generator with power and/or for driving said component electrically, the cable harness being led at least one of through the entire pressure equalization line and through a proximal end section of the pressure equalization line, which said end section has the proximal end.

7. A motor vehicle comprising:

an underbody arranged on the underside of the vehicle, the underbody facing ground, on which the vehicle stands or travels;

an exhaust system for removing exhaust gas from an internal combustion engine of the vehicle, the exhaust system being arranged, at least in an end section located away from the internal combustion engine, on the underside of the underbody, which said underside faces the ground, the exhaust system end section comprising an exhaust gas-carrying exhaust gas line; and a sound generator associated with the exhaust system, the sound generator comprising:

a housing;

an electroacoustic converter arranged in the housing, the electroacoustic converter comprising a membrane separating a rear volume from a front volume in the housing;

a connection pipe connecting the sound generator to the exhaust gas-carrying exhaust gas line of the exhaust system, the connection pipe connecting the front volume fluidically and acoustically with the exhaust system in a connected state; and a pressure equalization line having a pressure equalization line proximal end connected on to the housing and connected fluidically with the rear volume through an opening in the housing and having a pressure equalization line distal end arranged at a spaced location from the housing and vertically above the housing and the electroacoustic converter and the connection pipe with respect to a vertical direction, wherein the pressure equalization line has a line length extending away from a rear of the housing, away from to the electroacoustic converter and away from the connection pipe to the distal end, such that the distal end is spaced away from the rear of the housing, and spaced away from the electroacoustic converter and spaced away from the connection pipe by a distance that is greater than at least one of:

a diameter of the connection pipe at a connection pipe end facing away from the housing;

a diameter of the membrane; and a diameter of the housing in an area of the rear volume.

8. A motor vehicle in accordance with claim 7, wherein:

the distal end of the pressure equalization line is arranged on the underside of the underbody; and a distal end section of the pressure equalization line having the distal end is bent, so that the distal end is downwardly open.

9. A motor vehicle in accordance with claim 8, wherein the distal end section has a bent section, which defines a bend of at least 90°.

10. A motor vehicle in accordance with claim 7, wherein the pressure equalization line passes through the underbody, so that the distal end is arranged on the underside of the underbody, which said underside faces away from the ground.

11. A motor vehicle in accordance with claim 7, wherein the end section of the exhaust system, with the exhaust gas line and with the housing of the sound generator, is arranged below a predetermined maximum wading depth of the vehicle, while the distal end of the pressure equalization line is arranged above the wading depth.

12. A motor vehicle in accordance with claim 11, wherein the exhaust gas line leads to a tail pipe of the exhaust system, which said tail pipe is open towards a surrounding area, or is formed by the tail pipe, which opens below the maximum wading depth.

13. A motor vehicle in accordance with claim 12, further comprising:

a power supply;

an electroacoustic converter control, wherein the electroacoustic converter further comprises a membrane drive and the control controls the supply of power to the membrane drive of the electroacoustic converter by reducing or interrupting the supply of power to the membrane drive of the electroacoustic converter as soon as and as long as the front volume of the housing is flooded through the tail pipe.

14. A method of operating a motor vehicle, the method comprising the steps of:

providing a motor vehicle with an underbody arranged on the underside of the vehicle, the underbody facing ground, on which the vehicle stands or travels;

providing the motor vehicle with an exhaust system for removing exhaust gas from an internal combustion engine of the vehicle, the exhaust system being arranged, at least in an end section located away from the internal combustion engine, on the underside of the underbody, which said underside faces the ground, the exhaust system end section comprising an exhaust gas-carrying exhaust gas line;

providing a sound generator associated with the exhaust system, the sound generator comprising: a housing; an electroacoustic converter arranged in the housing, the electroacoustic converter comprising a membrane separating a rear volume from a front volume in the housing; a connection pipe connecting the sound generator to the exhaust gas-carrying exhaust gas line of the exhaust system, the connection pipe connecting the front volume fluidically and acoustically with the exhaust system in a connected state; a pressure equalization line having a pressure equalization line proximal end connected on to the housing and connected fluidically with the rear volume through an opening in the housing and having a pressure equalization line distal end arranged at a spaced location from the housing and vertically above the housing and a membrane drive and the connection pipe, with respect to a vertical direction, wherein the pressure equalization line has a line length extending away from a rear of the housing, away from to the electroacoustic converter and away from the connection pipe to the distal end, such that the distal end is spaced away from the rear of the housing, and spaced away from the electroacoustic converter and spaced away from the connection pipe by a distance that is greater than at least one of:

a diameter of the connection pipe at a connection pipe end facing away from the housing;

a diameter of the membrane; and a diameter of the housing in an area of the rear volume;

providing a power supply;

controlling the supply of power to the membrane drive of the electroacoustic converter by reducing or interrupting the supply of power to the membrane drive of the electroacoustic converter as soon as and as long as the front volume of the housing is flooded through the tail pipe.

15. A method in accordance with claim 14, wherein:

the distal end of the pressure equalization line is arranged on the underside of the underbody; and a distal end section of the pressure equalization line having the distal end is bent, so that the distal end is downwardly open.

16. A method in accordance with claim 15, wherein the distal end section has a bent section, which defines a bend of at least 90°.

17. A method in accordance with claim 14, wherein the pressure equalization line passes through the underbody, so that the distal end is arranged on the underside of the underbody, which said underside faces away from the ground.

18. A method in accordance with claim 14, wherein the end section of the exhaust system, with the exhaust gas line and with the housing of the sound generator, is arranged below a predetermined maximum wading depth of the vehicle, while the distal end of the pressure equalization line is arranged above the wading depth.

19. A method in accordance with claim 14, wherein the exhaust gas line leads to a tail pipe of the exhaust system, which said tail pipe is open towards a surrounding area, or is formed by the tail pipe, which opens below the maximum wading depth.

20. A motor vehicle internal combustion engine exhaust system sound generator according to claim 1, wherein the spaced location of the distal end is located vertically above the housing and the electroacoustic converter and the connection pipe, with respect to a vertical direction.

* * * * *